US006780069B2

(12) United States Patent
Scherer et al.

(10) Patent No.: US 6,780,069 B2
(45) Date of Patent: Aug. 24, 2004

(54) CONNECTOR ASSEMBLY

(75) Inventors: Richard J. Scherer, Austin, TX (US); Joseph N. Castiglione, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/317,690

(22) Filed: Dec. 12, 2002

(65) Prior Publication Data

US 2004/0115997 A1 Jun. 17, 2004

(51) Int. Cl.[7] ..... H01R 13/514
(52) U.S. Cl. ..... 439/752; 439/608; 439/595
(58) Field of Search ..... 439/752, 489, 439/157, 595, 751, 608, 607, 152, 101, 655, 701; 174/65 R, 59, 135, 72 A, 72 R

(56) References Cited

U.S. PATENT DOCUMENTS

| | | | | | |
|---|---|---|---|---|---|
| 4,804,341 | A | * | 2/1989 | Kato et al. | 439/752 |
| 5,125,854 | A | | 6/1992 | Bassler et al. | |
| 5,169,347 | A | | 12/1992 | Sang | |
| 5,184,965 | A | | 2/1993 | Myschik et al. | |
| 5,299,958 | A | * | 4/1994 | Ohsumi | 439/752 |
| 5,464,356 | A | * | 11/1995 | Nebeshima et al. | 439/752 |
| 5,516,308 | A | * | 5/1996 | Yamanashi | 439/752 |
| 5,653,613 | A | * | 8/1997 | Shimoda | 439/752 |
| 5,738,551 | A | * | 4/1998 | Matsuoka | 439/752 |
| 5,766,036 | A | | 6/1998 | Ahmad et al. | |
| 5,788,519 | A | | 8/1998 | Stern | |
| 5,839,923 | A | * | 11/1998 | Yoshida | 439/752 |
| 5,885,103 | A | | 3/1999 | Ernolf et al. | |
| 6,048,232 | A | | 4/2000 | Chen | |
| 6,146,202 | A | * | 11/2000 | Ramey et al. | 439/608 |
| 6,322,379 | B1 | * | 11/2001 | Ortega et al. | 439/608 |
| 6,338,654 | B1 | * | 1/2002 | Sasaki et al. | 439/595 |
| 6,352,444 | B1 | | 3/2002 | Yuzawa | |
| 6,368,120 | B1 | | 4/2002 | Scherer et al. | |

FOREIGN PATENT DOCUMENTS

| | | |
|---|---|---|
| EP | 0 343 561 A2 | 11/1989 |
| WO | WO 88/02560 | 4/1988 |

* cited by examiner

*Primary Examiner*—Anthony Dinkins
*Assistant Examiner*—Angel R. Estrada
(74) *Attorney, Agent, or Firm*—Yen Tong Florczak

(57) ABSTRACT

In one aspect, the invention relates to a carrier for use with an electrical connector assembly. The carrier comprises a housing, means for managing and securing terminated cable assemblies to the carrier, such as a combination of a clip and a cross-clip, and means for fastening a header onto the housing. The carrier provides controlled impedance and allows for quick and easy access to the header and the terminated cable assemblies in the event that replacement is necessary.

11 Claims, 5 Drawing Sheets

CONNECTOR ASSEMBLY

TECHNICAL FIELD

The present invention relates to a high speed connector. In particular, the present invention relates to a connector that provides for controlled impedance and allows for quick and easy replacement of components.

BACKGROUND

Interconnection of integrated circuits to other circuit boards, cables or electronic devices is known in the art. Such interconnections typically have not been difficult to form, especially when the circuit switching speeds (also referred to as signal transmission times) have been slow when compared to the length of time required for a signal to propagate through a conductor in the interconnect or in the printed circuit board. As signal transmission times continue to increase with modern integrated circuits and related computer technology, the design and manufacture of interconnects that can perform satisfactorily has grown more difficult.

There is a growing need to design and manufacture electrical interconnects with closely controlled electrical characteristics to achieve satisfactory control of the signal integrity. The extent to which the electrical characteristics (such as impedance) can be controlled depends on the switching speed of the circuit, i.e., the faster the circuit switching speed, the greater the importance of providing an accurately controlled impedance within the interconnect.

Connectors have been developed to provide the necessary impedance control for high speed circuits, i.e., circuits with a transmission frequency of at least 5 GHz. Although many of these connectors are useful, there is still a need in the art for different and more economical connector designs that provide for easy component replacements.

SUMMARY

The present invention pertains to a connector assembly designed to provide controlled impedance to maintain signal and ground integrity, and to allow for quick and easy assembly and disassembly for replacing components or for modifying or upgrading with different components. In this way, the present invention provides economic advantages to the consumer in that only the selected component in the connector assembly needs to be replaced instead of replacing the entire assembly.

In one aspect, the present invention provides a carrier for use with an electrical connector assembly. The carrier comprises an insulating housing and means for securing the terminated cable assemblies. Optionally, the carrier further comprises a means for managing the terminated cable assemblies. In one exemplary embodiment, means for securing and means for managing the terminated cable assemblies are integrated. The housing includes a front vertical wall, laterally extending top and bottom walls, at least one set of carrier clip holes disposed on at least one of the top and bottom walls, and means for fastening a header to the housing.

In another aspect, the present invention provides another carrier for use with an electrical connector assembly. The carrier comprises an insulating housing having a front vertical wall and laterally extending top and bottom walls. The front vertical wall has an interior and an exterior surface. The housing also has at least one latch and at least one set of carrier clip holes, both disposed on at least one of the top and bottom walls. The carrier further comprises at least one clip having a back and plurality of ribs extending from the back. The clip is disposed in the housing such that the ribs mate with the carrier clip holes in the housing. In another exemplary embodiment, the carrier further comprises at least one cross-clip having at least one interference shoulder and a plurality of organizers. The cross-clip is disposed in the housing such that the interference shoulder rests against at least one of the top and bottom walls of the housing.

As discussed in detail below, the header, with its plurality of signal pins and ground blades, tends to be susceptible to damage. In the event that a header does become damaged or needs to be upgraded or modified, the connector assembly can be quickly disassembled so the header can be replaced. And, the connector assembly has been designed to allow for quick and easy replacement of the shielded electrical cable, if desired.

The above summary of the present invention is not intended to describe each disclosed embodiment or every implementation of the present invention. The Figures and detailed description that follow below more particularly exemplify illustrative embodiments.

These figures are idealized, not drawn to scale and are intended only for illustrative purposes.

DETAILED DESCRIPTION

Figure 1:
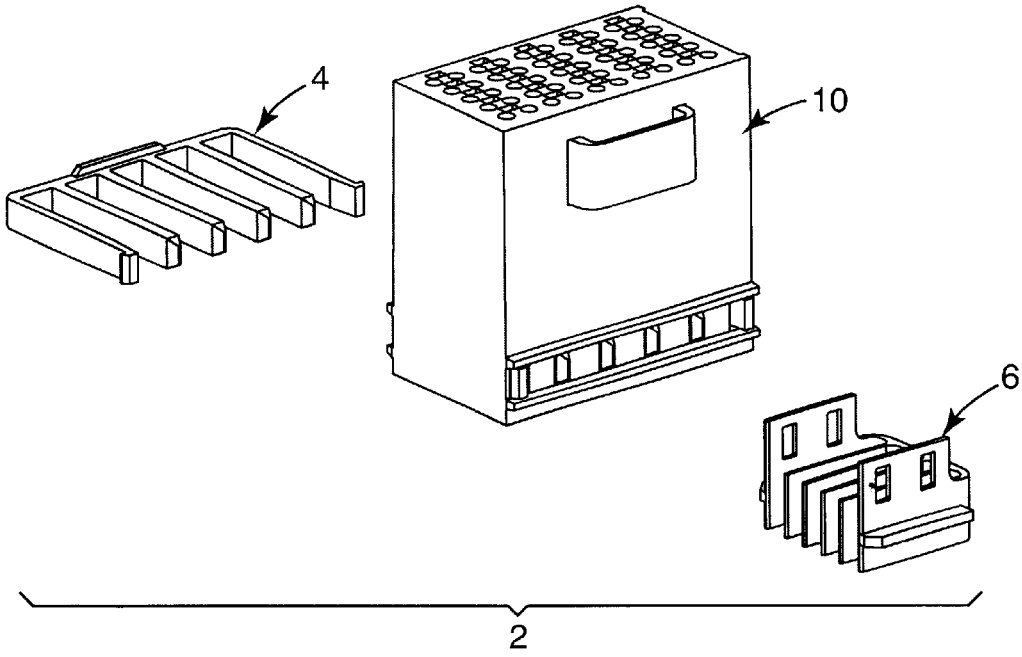
FIG. 1 is an isometric view of an exemplary carrier in accordance with one aspect of the present invention.

FIG. 1 shows one embodiment of carrier 2 having housing 10 and means for securing and managing terminated cable assemblies, which can be mechanical devices that are used to hold and to maintain order in the terminated cable assemblies to minimizing their entanglement. FIG. 1 shows one means for securing and managing the terminated cable assemblies, which includes clip 4 and cross-clip 6. The carrier can be made by any conventional means, such as by injection molding.

Figure 2A:
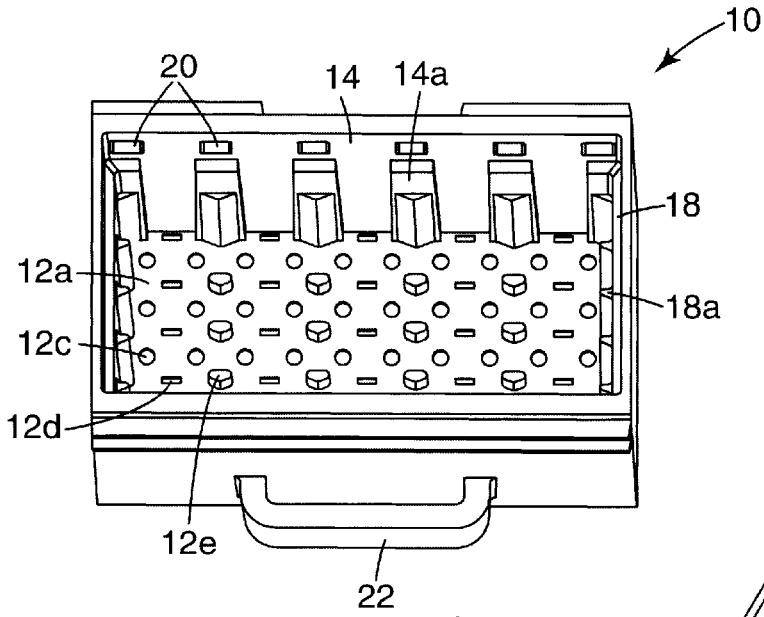
FIGS. 2A and 2B are isometric views of an exemplary housing used in the carrier in accordance with another aspect of the present invention.
Figure 2B:
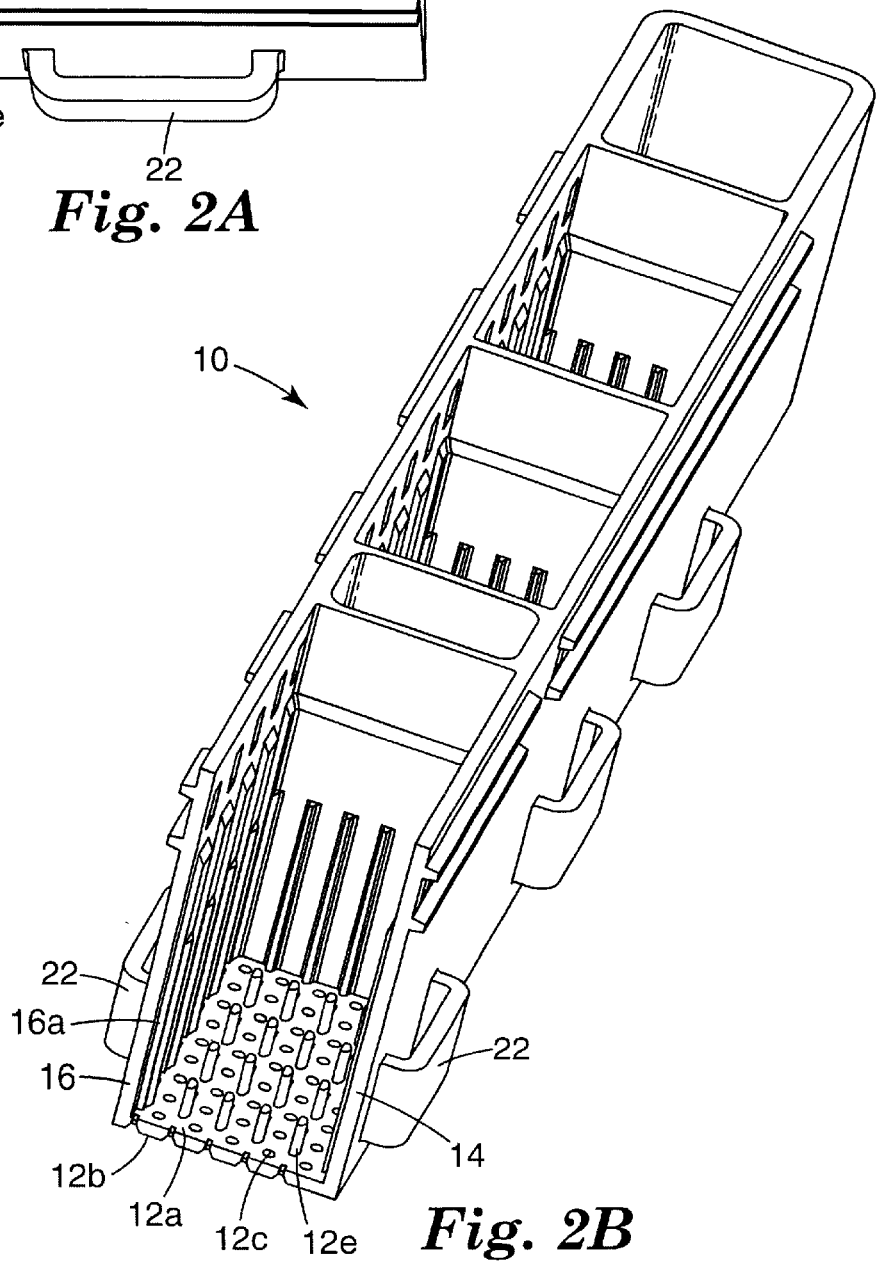

FIGS. 2A and 2B show isometric views of the housing made from insulating material. Housing 10 contains a generally vertically-extending front wall 12 having interior surface 12*a* and exterior surface 12*b*. The front wall is formed to include a plurality of pin insertion apertures 12*c* arranged in rows and columns. In between the pin insertion apertures are blade insertion apertures 12*d* and supports 12*e*, which are disposed on interior surface 12*a*. The supports aid in the alignment of the terminated cable assemblies described below. The housing also includes pair of laterally-extending top and bottom walls 14 and 16 respectively, each optionally having a series of guides 14*a* and 16*a*. Side walls 18, with guides 18*a*, also form part of the housing. On at least one of the laterally-extending top and bottom walls, there are a plurality of carrier clip holes 20 to accommodate means for securing and managing terminated cable assemblies. Also means to fasten a header is disposed on at least one of the top and bottom walls. As shown in FIG. 2A, one means to fasten the header to the housing is a latching device 22, i.e., a device in which mating mechanical parts engage to fasten but usually not to lock the header to the housing.

Figure 3A:
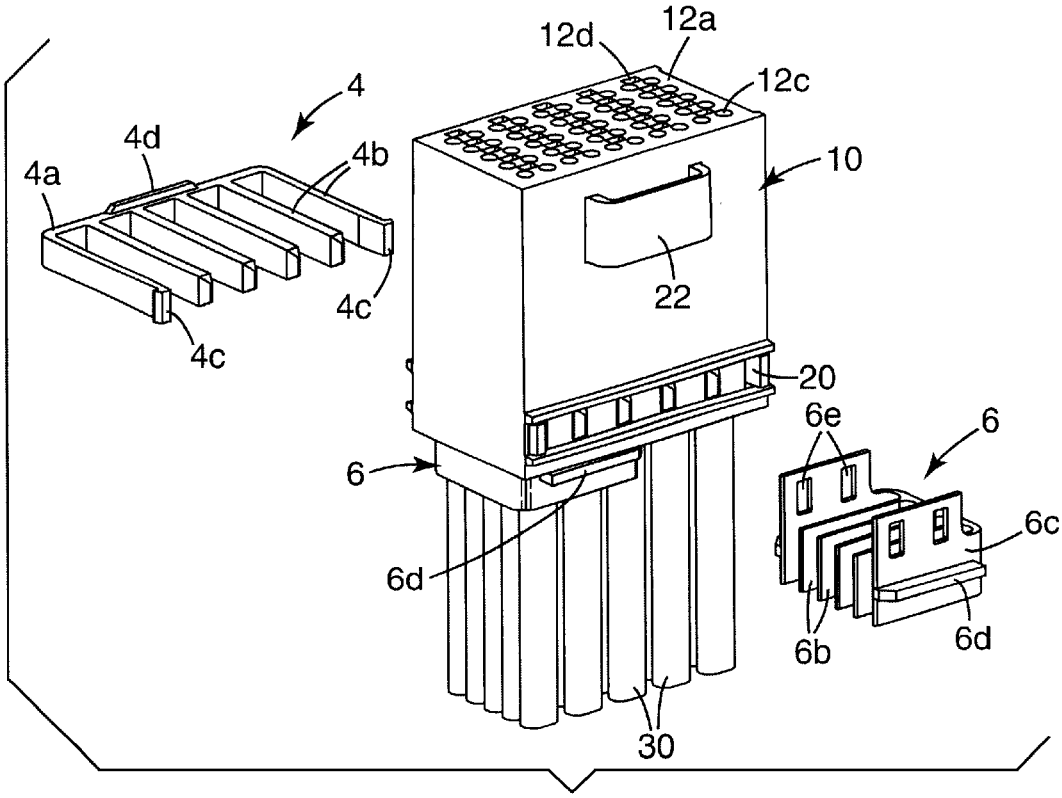
FIGS. 3A and 3B are isometric views of a carrier containing terminated cable assemblies in accordance with another aspect of the present invention.
Figure 3B:
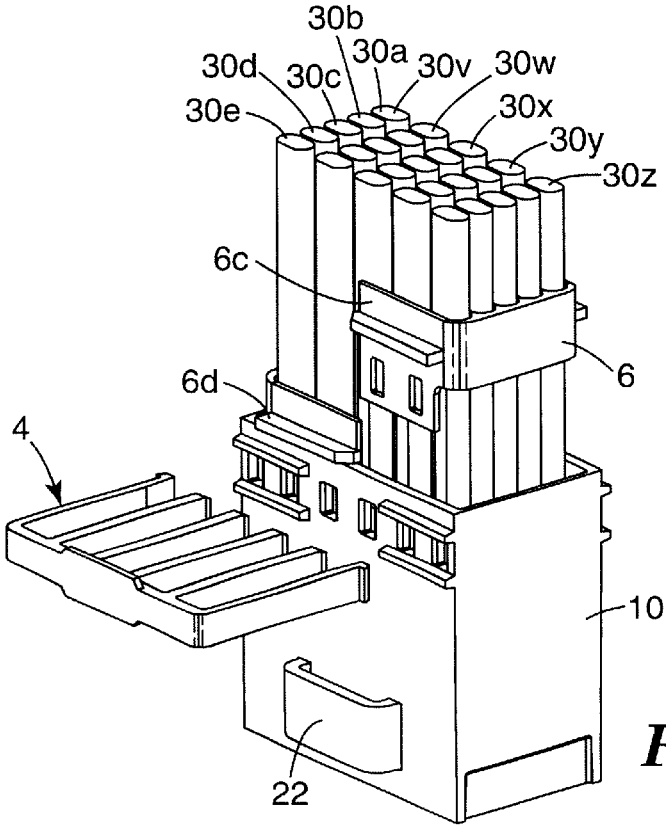

FIGS. 3A and 3B show two different views of the carrier with terminated cable assemblies 30 mounted therein. These figures best show how means for securing and means for managing the terminated cable assemblies (i.e., the combination of clip 4 and cross-clip 6) function in conjunction with housing 10. The clip has a plurality of ribs 4*b* extending laterally from back 4*a*, optional snapping features 4*c* on the end ribs and optional finger tab 4*d* on at least one side of the back to aid in the assembly and disassembly of the clip from the carrier clip holes 20 disposed in housing 10. In one embodiment, the number of ribs 4*b* matches the number of holes 20, although it is within the scope of the present invention to have a different number of ribs than holes, e.g., less ribs than holes. In one embodiment, where snapping feature 4*c* is used, the length of the clip, as measured from back 4*a* to the end of ribs 4*b* is about the same length as that of the housing from the top wall 14 to the bottom wall 16 such that when the clip is attached to top wall 14 of the housing through holes 20, snapping feature 4*c* extends from bottom wall 16. The clip is typically an integrally molded piece of insulating material.

Cross-clip 6 includes a plurality of organizers 6*b*, and at least one end 6*c*. Located on end 6*c* is interference shoulder 6*d*, and optionally a plurality of interlocking apertures 6*e*. If two ends 6*c* are used, the second end may or may not include the interference shoulder or the interlocking apertures. The width of the cross-clip, as measured from one end to the other, or if two ends are not used, from one end to the last organizer furthest away from the end, is about the same as the distance from top wall 14 to bottom wall 16 of the housing.

As shown in FIG. 3B, the cross-clip slides over the terminated cable assemblies 30 until interference shoulder 6*d* on end 6*c* abuts top wall 14 of the housing. In this case, ribs 6*b* segregates rows 30*a*, 30*b*, 30*c*, 30*d*, and 30*e* from one another and the interlocking apertures, if used, are aligned with carrier clip holes 20 on the housing 10. If two ends 6*c* are used, the interference shoulder on the second end would abut bottom wall 16 of the housing. Once the cross-clip has been installed so that the interference shoulder stops against at least one of the top or bottom walls, clip 4 is then installed such that ribs 4*b* slide into holes 20 on the housing and back 4*a* of the clip rests on top wall 14. If two clips are used, the second clip rests on bottom wall 16 of the housing. As the clip slides into holes 20, it also slides into interlocking apertures 6*e* (if used) on the cross-clip, thereby holding it in place. Each of the four internal rib 4 (i.e., excluding the two end ribs) of the clip separates columns 30*v*, 30*w*, 30*x*, 30*y*, and 30*z* of terminated cable assemblies. Although FIG. 3B shows an array of five columns and five rows of terminated cable assemblies, any number of columns and rows can be used and the designation of the column and the row are arbitrary, i.e., a column can be a row. With this design, a user can easily replace terminated cable assembly by removing clip 4 and cross-clip 6 and then removing the individual cable.

Figure 4:
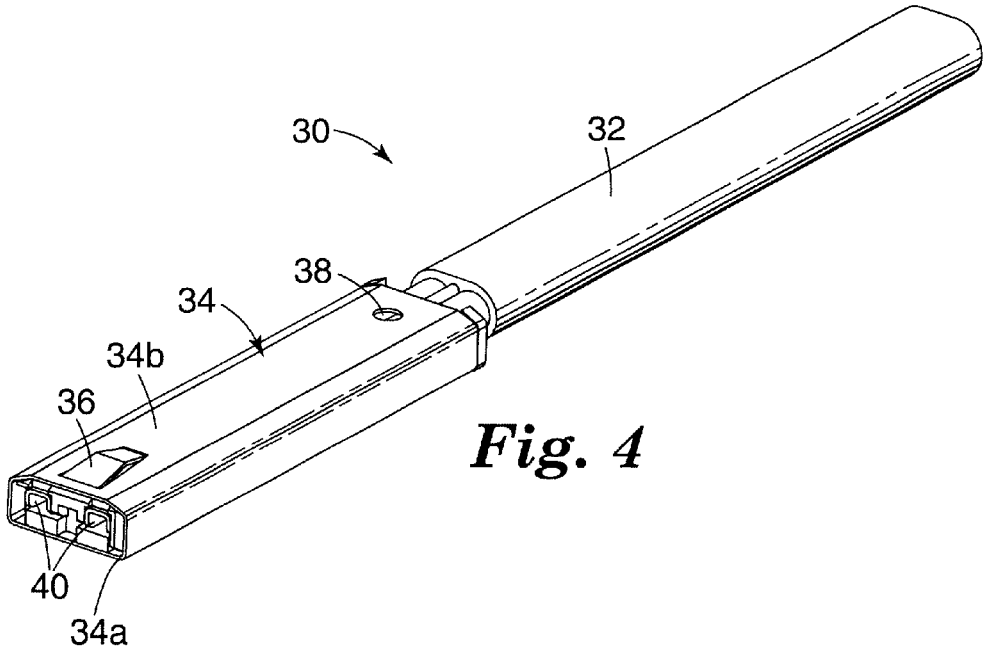
FIG. 4 is an isometric view of an exemplary terminated cable assembly that can be used in conjunction with the present invention.

FIG. 4 shows one exemplary embodiment of a terminated cable assembly that can be used in conjunction with the carrier. Terminated cable assembly 30 are conventional in design, except that each termination device 34 includes contact beam 36 on the top surface 34*b* for making electrical contact with the ground blades in the header, discussed below. Electrical cable 32 is attached to termination device 34 through the use of solder openings 38. The type of electrical cable used in this invention can be a single wire cable (e.g. single coaxial or single twin axial) or a multiple wire cable (e.g. multiple coaxial or multiple twin axial or twisted pair cables). In use, the terminated cable assemblies are inserted into housing 10 such that front face 34*a* of termination devices 34 abuts interior surface 12*a* of the front vertical wall of the housing 10. Female contacts 40 lies along the longitudinal axis of the termination device and aligns with pin insertion apertures 12*c* of the front vertical wall of the housing. Thus, a portion of the termination device rests on support 12*d*. Top wall guide 14*a* and bottom wall guide 16*a* also help position the first and last termination device in the column.

Figure 5:
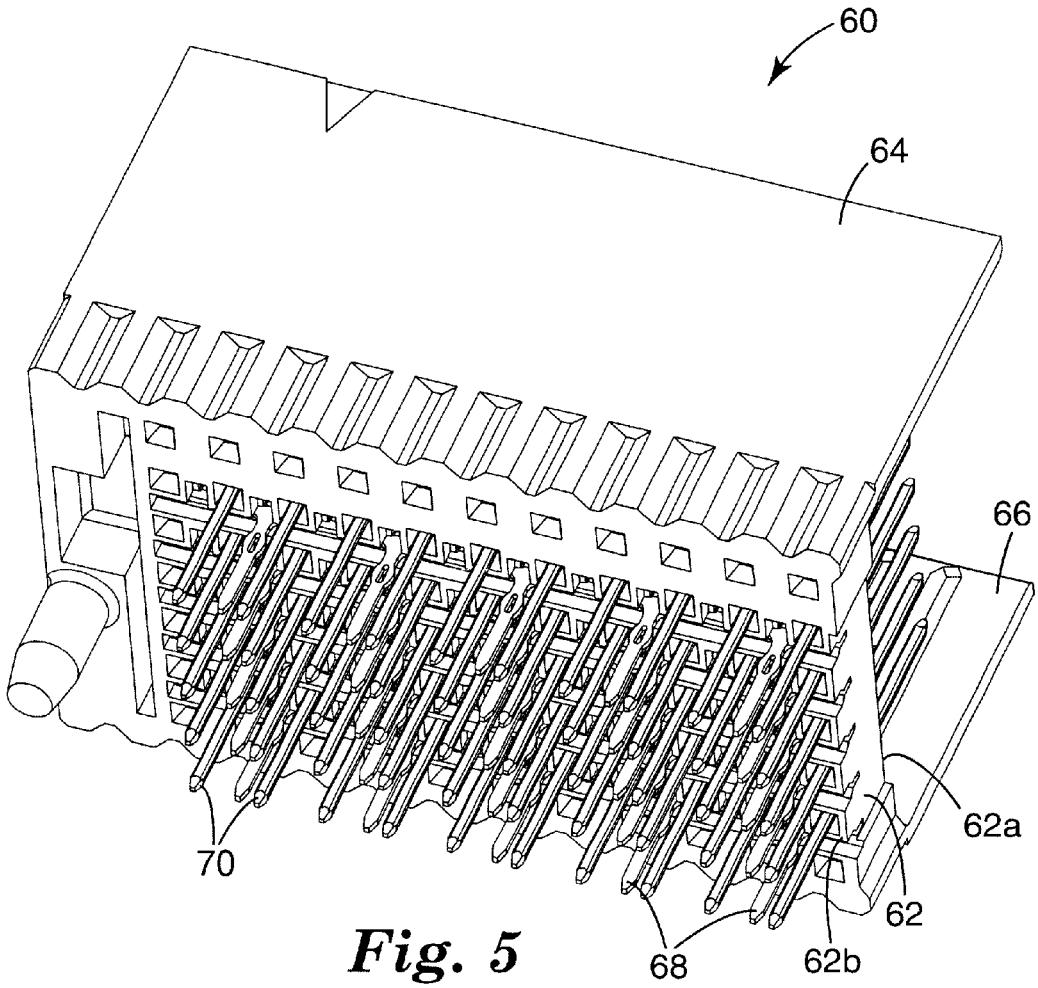
FIG. 5 is an isometric view of an exemplary header that can be used in conjunction with the present invention.

FIG. 5 shows an exemplary pin header 60 that can be used in the present invention. The header includes vertical front wall 62, having interior surface 62*a* and exterior surface 62*b*, and laterally extending top and bottom walls 64 and 66 respectively. The vertical front wall is formed to include a plurality of pin insertion windows for signal pins 70 and a plurality of blade insertion windows for ground blades 68. In use, the header is mated with the carrier 2 such that exterior surface 62*b* of the header is in contact with exterior surface 12*b* of the housing so that signal pins 70 and ground blades 68 slide through pin insertion apertures 12*c* and blade insertion apertures 12*d* respectively to mate with female contacts 40 and ground contacts 36 respectively of the terminated cable assembly. Another useful pin header that can be used in the present invention is disclosed in U.S. Pat. No. 6,146,202 (Ramey et al.), which is hereby incorporated by reference in its entirety.

Although FIG. 4 shows that termination device 34 contains contact beam 36, it is within the scope of the present invention to place the contact beam on the ground blade 68 in the header or on both termination device 34 and ground blade 68.

Figure 6:
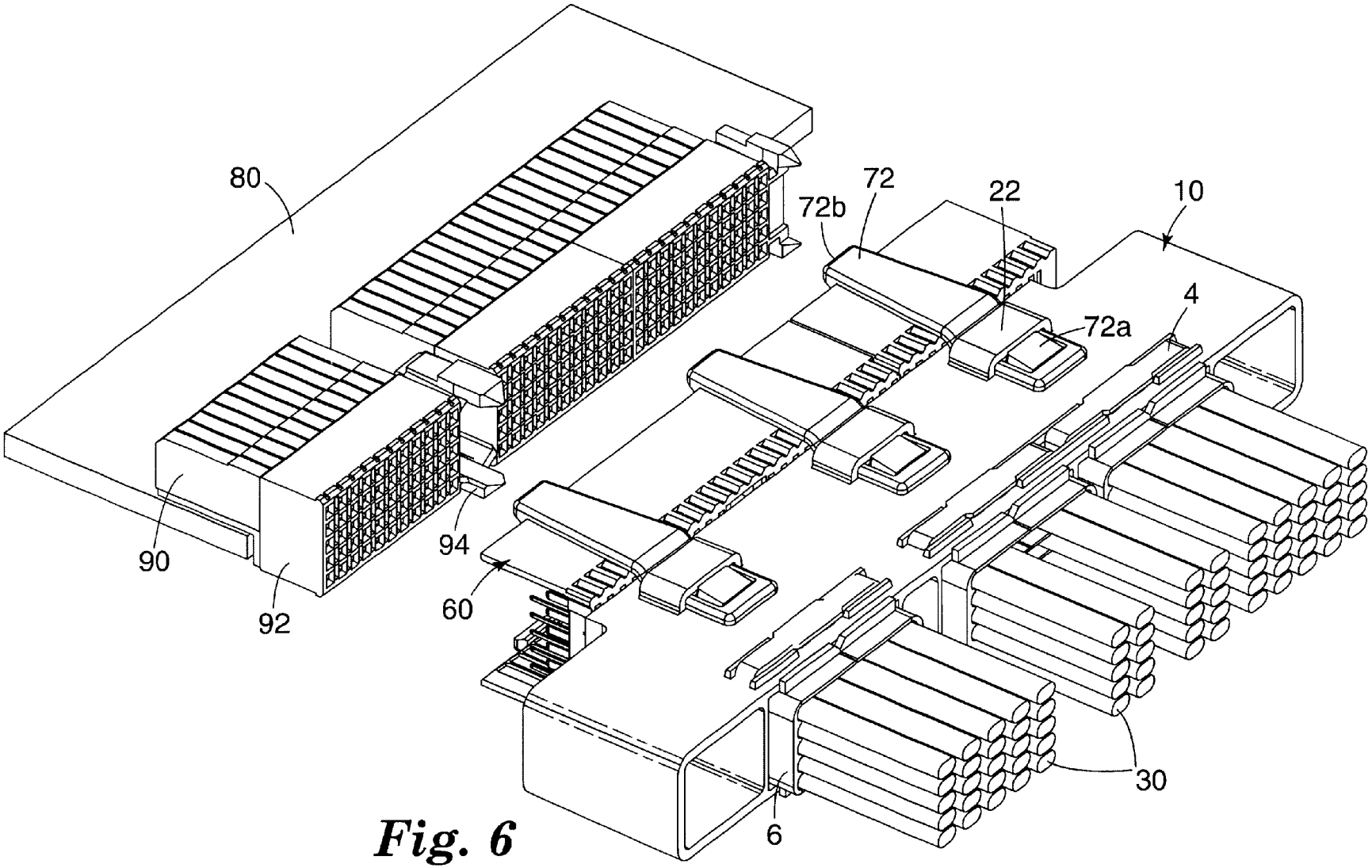
FIG. 6 is a perspective view of an exemplary high speed electrical connector assembly in a partially unassembled stage, in accordance with another aspect of the present invention.

FIG. 6 shows a partially assembled high speed connector used in conjunction with printed circuit board (PCB) 80. As shown, terminated cable assemblies 30 are attached to one side of the carrier while header 60 is attached on the other side. The header further includes means for fastening to the carrier. In this particular embodiment, the means for fastening is retaining clip 72 having tab 72*a* and clip end 72*b*. In use, tab 72*a* of the retaining clip slides under latching device 22 on housing 10 to hold the header to the carrier.

In another embodiment, means for fastening the header to the carrier (having the terminated cable assemblies attached) is done through the use of sufficiently high friction force between the ground blades in the header to the termination device. Alternatively or in addition to this friction force, the header could be fastened to the carrier through sufficiently high friction force between the signal pins in the header and the female contacts in the terminated cable assemblies.

In the event that a header is damaged or needs to be upgraded or modified, it can be replaced by spreading clip ends 72*b* apart, removing the existing header, and installing a new header. In this way, the present invention provides an economical and user friendly design that allows for replacement of headers. Although FIG. 6 shows several retaining clips 72 used with several latching devices 22 on the top wall of the housing, similar retaining clips and latching device combinations can be used on the bottom wall of the housing. Also, any number of header and carrier combinations can be used together even though two are shown. On PCB 80 is mounted a plurality of connector modules 90 assembled in socket 92. The PCB, connector module, and socket are all in electrical communication the each other. If desired, optional male guides 94 can be added to socket 92 to help guide the socket into the header. In this case, the header would contain complimentary female guides (not shown). Useful connector modules and sockets are disclosed in U.S. Pat. No. 6,146,202 (Ramey et al.). As one skilled in the art will recognize, to complete the electrical circuit, the header/carrier/terminated cable assembly is mated to the socket. Although the above description recites a particular sequence to assemble the high speed connector, one skilled in the art will recognize that different assembly sequences can be used.

What is claimed is:

1. A carrier for use with an electrical connector assembly, said carrier comprising:

(a) an insulating housing having a front vertical wall and laterally extending top and bottom walls, at least one latch, and at least one set of carrier clip holes disposed on at least one of said top and bottom walls;

(b) at least one clip having plurality ribs extending from a back; said clip disposed in said housing such that said ribs mate with said carrier clip holes in said housing; wherein said front vertical wall includes a plurality of pin insertion apertures disposed between rows and columns of blade insertion apertures and has interior and exterior surfaces; and (c) at least one cross-clip having at least one end and a plurality of ribs wherein said end of said cross-clip has at least one interference shoulder and at least one interlocking aperture and wherein said cross-clip is disposed in said housing such that said interference shoulder rests against at least one of said top and bottom walls of said housing.

2. An electrical connector assembly comprising:

(a) the carrier of claim 1; and (b) a plurality of terminated cable assemblies comprising an electrical cable attached to a termination device, wherein said termination device has a ground contact beam disposed on its top surface, a front face, and at least one female contact lying parallel to the longitudinal axis of the terminated cable assemblies, wherein said terminated cable assemblies is disposed in said carrier such that said front face of said termination device is in contact with said internal surface of said housing.

3. The electrical connector assembly of claim 2 further comprising a header, said header comprising:

(a) a front vertical wall having an interior surface and an exterior surface; and (b) an array of signal pins disposed between rows and columns of ground blades, wherein said signal pins and ground blades extend through said front vertical wall, and wherein said header is disposed in said carrier such that said exterior surface of said header abuts said exterior surface of said carrier and said signal pins in said header advance through said front vertical wall of said housing to reside in said female contacts of said terminated cable assembly and said ground blades in said header advance through said front vertical wall of said housing to contact said ground contact on said termination device.

4. The electrical connector assembly of claim 3 further comprising means for fastening said carrier to said header.

5. The electrical connector assembly of claim 4 wherein said means for fastening comprises a latching device disposed on at least one of said top or bottom wall of said housing of said carrier and a retaining clip disposed on at least one of said top and bottom walls of said header.

6. The electrical connector assembly of claim 5 further comprising:

(a) a socket mated to said interior surface of said vertical wall of said header;

(b) a plurality of connector modules attached to said socket; and (c) a printed circuit board attached to said connector modules, wherein said printed circuit board, connector modules, socket, header, carrier, and terminated cable assembly are in electrical communication.

7. An electrical connector assembly comprising:

(a) the carrier of claim 1;

(b) a plurality of terminated cable assemblies comprising an electrical cable attached to a termination device, wherein said termination device has a front face and at least one female contact lying parallel to the longitudinal axis of the terminated cable assemblies, and wherein said terminated cable assemblies is disposed in said carrier such that said front face of said termination device is in contact with said internal surface of said housing.

8. The electrical connector assembly of claim 7 further comprising a header, said header comprising:

(a) a front vertical wall having an interior surface and an exterior surface; and (b) an array of signal pins disposed between rows and columns of ground blades having a contact beam, wherein said signal pins and said ground blades extend through said front vertical wall, and wherein said header is disposed in said carrier such that said exterior surface of said header abuts said exterior surface of said carrier and said signal pins in said header advance through said front vertical wall of said housing to reside in said female contacts of said terminated cable assembly and said ground blades in said header advance through said front vertical wall of said housing to contact said termination device.

9. The electrical connector assembly of claim 8 further comprising:

(a) a socket mated to said interior surface of said vertical wall of said header;

(b) a plurality of connector modules attached to said socket; and (c) a printed circuit board attached to said connector modules, wherein said printed circuit board, connector modules, socket, header, carrier, and terminated cable assembly are in electrical communication.

10. The electrical assembly of claim 2 further comprising a header, said header comprising:

(a) a front vertical wall having an interior surface and an exterior surface; and (b) an array of signal pins disposed between rows and columns of ground blades having a contact beam, wherein said signal pins and said ground blades extend through said front vertical wall, wherein said header is disposed in said carrier such that said exterior surface of said header abuts said exterior surface of said carrier and said signal pins in said header advance through said front vertical wall of said housing to reside in said female contacts of said terminated cable assembly and said ground blades in said header advance through said front vertical wall of said housing to contact said ground contact beam on said termination device.

11. The electrical connector assembly of claim 10 further comprising:

(a) a socket mated to said interior surface of said vertical wall of said header;

(b) a plurality of connector modules attached to said socket; and (c) a printed circuit board attached to said connector modules, wherein said printed circuit board, connector modules, socket, header, carrier, and terminated cable assembly are in electrical communication.

* * * * *